United States Patent [19]

Grauer et al.

[11] 4,216,633

[45] Aug. 12, 1980

[54] PROCESS AND APPARATUS FOR ELEVATING A FOLDING ROOF SYSTEM

[75] Inventors: Edward C. Grauer, Lansdale; William H. Kennedy, Wyncote, both of Pa.

[73] Assignee: General Electric Company, Philadelphia, Pa.

[21] Appl. No.: 905,069

[22] Filed: May 11, 1978

[51] Int. Cl.[2] ..... E04D 15/00

[52] U.S. Cl. ..... 52/122; 52/127; 52/749

[58] Field of Search ..... 52/66, 125, 745, 749, 52/127, 122

[56] References Cited

U.S. PATENT DOCUMENTS

| | | | |
|---|---|---|---|
| 3,375,624 | 4/1968 | Mikulin | 52/109 |
| 3,557,500 | 1/1971 | Schmidt | 52/109 |
| 3,694,022 | 9/1972 | Dontigny | 52/66 |
| 3,724,157 | 4/1973 | Miram | 52/125 |
| 3,924,889 | 12/1975 | Gogush | 52/66 |
| 3,975,872 | 8/1976 | Pinero | 52/109 |

FOREIGN PATENT DOCUMENTS

| | | | |
|---|---|---|---|
| 2309555 | 9/1973 | Fed. Rep. of Germany | 52/66 |
| 1495511 | 2/1967 | France | 52/109 |

*Primary Examiner*—Price C. Faw, Jr.
*Assistant Examiner*—Henry E. Raduazo
*Attorney, Agent, or Firm*—Stephen A. Young

[57] ABSTRACT

A lifting apparatus for elevating folding roof sections comprises a pair of jackknifing lifting bars. A hoist means transmits a pulling force to the bars, thereby enabling each bar to unfold from a initial folded configuration into an extended straight configuration. The bars elevate first roof sections to an intermediate pitch while unfolding into the straight configuration and while rotating into a generally vertical position with respect to the first roof sections. Remaining roof sections, together with the first roof sections, are elevated to a desired pitch with the bars in the straight configuration by applying additional force. Additional force causes the bars to rotate from the vertical position into a generally horizontal position while lifting both first and second roof sections to the desired pitch. At the start of the lift, all roof sections are horizontally folded and substantially supported on first segments of hinge plates fastened thereto. Second segments of these hinge plates are attached to the top ends of interconnecting side walls. During elevation, the lifting of the roof sections causes the first segments to bend to an angle determined by the pitch of the roof sections. Subsequent to adjusting the roof sections to a final pitch and position, end gables are installed and replace the hinge plates in the function of substantially supporting the roof sections. Eliminating the force from the hoist means allows the bars to refold and be removed.

5 Claims, 4 Drawing Figures

STEP-1
41
35
33A
7A
33
1
7
33
43
13A
1
25A
37
47
33B
29
51
13
25
7B
55

STEP-2

STEP-3

STEP-4

STEP-5

PROCESS AND APPARATUS FOR ELEVATING A FOLDING ROOF SYSTEM

BACKGROUND OF THE INVENTION

1. Field of the Invention

This invention relates to building construction, and more particularly relates to a lifting apparatus and process for elevating a folding roof.

2. Description of the Invention

In modular building construction, building sections are typically prefabricated and interconnected at a factory and are transported to a site by common carriers such as: trailers, trucks, trains, etc. for erection. The common carriers travel on roadways or trackways that are governed by interstate and intrastate commerce regulations and laws.

Many of these laws and regulations are enacted to provide for safety and health during transportation by imposing limitations on: height, weight, size, and contents of material that the prefabricated building sections may comprise. In particular, regulations concerning height limitations have posed difficult problems for manufacturers in building and designing roofs with enough pitch for most commercial and residential purposes. For example, manufacturers find that it is almost impossible or extremely difficult to construct and interconnect a roof at the factory with a pitch and height which can be either transported on common carriers while complying with the laws regulating height, or be erected simply, quickly, and economically at their ultimate destination when the interconnected roof is transported at a pitch and height less than that required by its design.

An additional complication for manufacturers is the fact that if a roof is not attached to the construction during transport, environmental conditions such as: rain, snow, wind and extreme heat and cold may cause serious and undesirable damage to exposed parts of the construction normally protected from environmental conditions by the roof.

Earlier attempts to solve the above difficulties entailed transporting to the site of erection an inclined roof consisting of a lower fixed section and an upper section. The upper section is pivoted to the fixed section to swing between an operative erected position and a lower inclined transport position. Such a construction, however, necessitates a complex arrangement of uprights and rafters to support and elevate the roof, and also requires difficult and substantial fabrication procedures at the factory and at the site of the erection.

Another attempt teaches pivotally mounting a roof section at the center so that it may pivot and be swung into a horizontal position during transport. But this construction increases the overall width of the modular building at the roof when in a horizontal position. It also entails substantial construction at the site of erection and substantial accessories to support the roof in a transport position.

Thus, it is an object of this invention to provide modular building structures with a prefabricated roof that will meet both the commerce laws imposing height limitations on a pitch of the roof and provide adequate environmental protection during transportation by common carriers.

It is another object of this invention to provide a prefabricated roof for modular building structures that can be factory installed in a folded position and elevated to a final position at the site of erection with minimal construction and accessories.

It is still an object of this invention to provide simply constructed lifting bars for erecting prefabricated roofs for modular building structures from a height in compliance with commerce laws regulating the height of objects transported by common carriers to a greater height as required by design specifications for the structures.

It is still a further object of this invention to provide a hinge that substantially supports a prefabricated roof when initially folded but that does not substantially support the roof when unfolded and elevated to its final pitch and position.

It is still a further object of this invention to provide a process and apparatus for elevating folded prefabricated roofs in modular building structures at the site of erection to a desired pitch and position with minimum construction and accessories.

SUMMARY OF THE INVENTION

A pair of jackknifing, folding, lifting bars are utilized to raise or elevate horizontally folded roof panel sections that are attached to modular type housing constructions. Each pair of lifting bars comprises two elongated bars. A first elongated bar of the two includes a first circular end with a sheave and a second end with a locking clasp. The end with the sheave is adaptable for rotatively engaging first roof sections. The second elongated bar has a first end which is pivotally connected to second roof sections, and a second end that is pivotally connected to the first elongated bar intermediate its circular end and end with the locking clasp, thereby enabling the first and second elongated bars to acquire either a folded or a straight configuration.

A flexible member is connected between a hoist and each pair of lifting bars. A lower end of the flexible members is connected at each pivotal connection of the pair of lifting bars and extends to engage the sheave of each first elongated bar.

In the process for elevating the roof sections, an initial upward pulling force, implemented by the hoist, is transmitted to each pair of lifting bars at their pivotal connection points and at their sheaves by the flexible member while the lifting bars are in the folded or start configuration. The force enables the lifting bars to unfold by causing the circular ends of the first elongated bars to rotate upwards while the ends with the clasps rotate downward and lock to the second elongated bars. The clasps on the first elongated bars latch to the second elongated bars intermediate both ends of the second elongated bars by which the first and second elongated bars form the straight configuration.

During the unfolding, the pair of lifting bars elevate the first roof sections from an initial pitch to an intermediate pitch, while simultaneously rotating into a generally vertical position with respect to the first roof sections. That is, the first roof sections are raised to an intermediate pitch by raising the first roof sections until the lifting bars rotate into an extended, straight, locked bar configuration positioned generally vertically with respect to the first sections.

Additional force is applied to the lifting bars while the lifting bars are in the straight configuration and until the lifting bars rotate from the vertical position into a generally horizontal position, at which time, the first roof sections are further elevated simultaneously with the second roof sections. Both the first and second roof sections are respectively elevated simultaneously from their intermediate pitch and folded position to a different pitch of a height greater than that needed to install end gables. In short, remaining second roof sections, together with the first sections, are raised until the lifting bars rotate from the vertical position to a generally horizontal position.

In addition to the above, the roof sections during the application of the upward forces exert pivotal forces upon a plurality of metal hinge plates positioned at corner junctions between side walls of the building structure and the roof sections. First and second segments of the plates secure the plates at the junctions. The first segments are fastened to the roof sections and substantially support the roof sections, while the second segments of the plates are attached to top ends of the side walls. The pivotal forces act on the first segments and cause the first segments to bend at an angle to the side walls. The approximate size of the angle is determined by the final pitch and position of the elevated roof sections.

End gables are installed subsequent to elevation, and the roof sections are lowered into the final pitch and position. In the final position, the roof sections are substantially supported by the end gables rather than by the first segments of the hinge plates.

Removal of the forces on the lifting bars enables the lifting bars to partially refold by rotating out of the straight configuration and horizontally orientated position into a partially folded configuration. When in the partially folded configuration, the lifting bars may be removed and reused for erecting other roof sections when applicable.

DETAILED DESCRIPTION OF THE DRAWING

Figure 1:
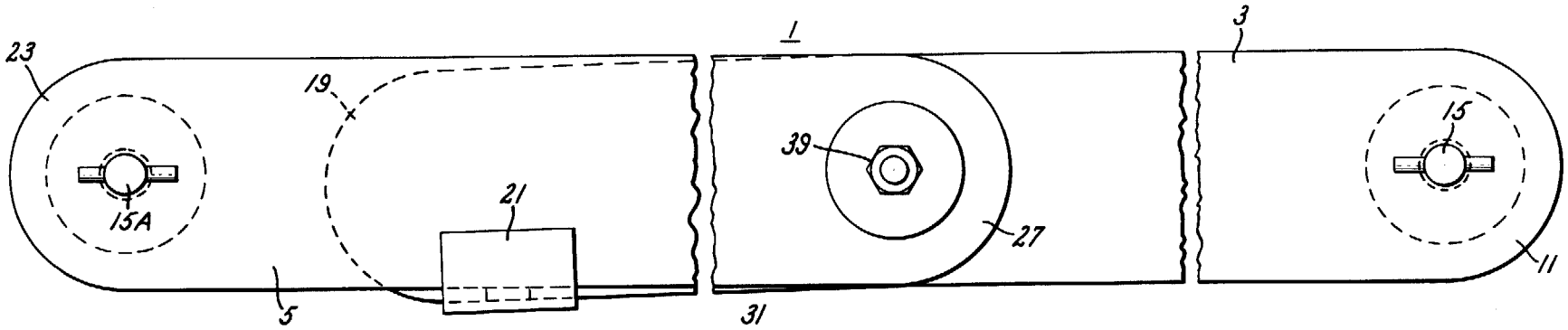
FIG. 1 illustrates a front view of the lifting bars, in the straight configuration, for elevating roof panel sections in accordance with the principles of this invention.
Figure 2:
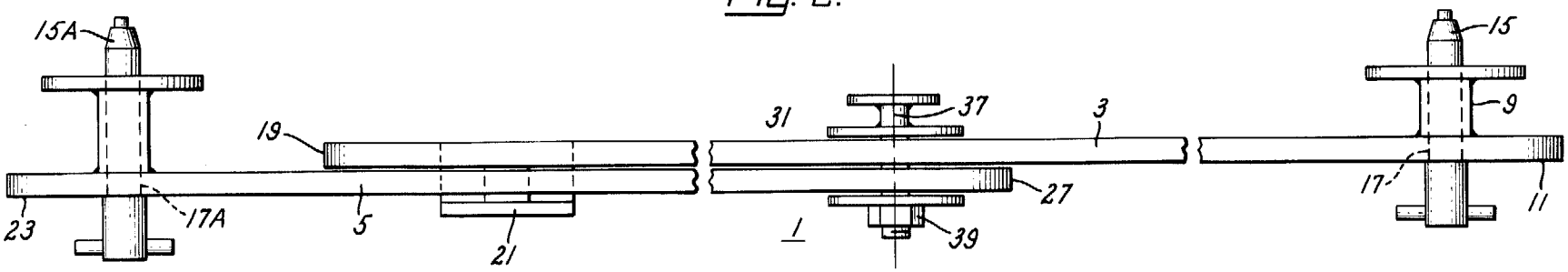
FIG. 2 illustrates a top view of the lifting bars of FIG. 1.

Jackknifing lifting bars 1, illustrated in a prefereed embodiment at FIGS. 1 and 2, comprises two pieces of flat, elongated, rectangular, metal bars 3 and 5 that are connected to one another. Lifting bars 1, however, are not limited to either the flat elongated rectangular geometry, or to being constructed from only metal. For generally speaking, any material of any shape and form with sufficient strength to withstand fracture or failure during the process of elevating the roof panel sections may be utilized. Roof panel sections are generally designated as 7 and are clearly illustrated in FIG. 3.

First bar 3 has an approximate thickness of ½ inch (12.7 mm) an approximate length of 52 inches (1320.8 mm), and an approximate width of 2½ inches (73.5 mm). A sheave 9 is attached at one end 11 of first bar 3. End 11 is adaptable for rotatively engaging sides 13 and 13A of a first roof section 7A. End 11 engages side 13 and 13A through pivotal fasteners 15. Fasteners 15 extend through aperture 17 within bar 3 and into sides 13 and 13A to connect each end 11 of the pair of lifting bars 1 to roof sections 7. An opposite end 19 of bar 3 has a lock or latch 21 which projects or angles out from end 19.

Second bar 5 of lifting bars 1 has an approximate thickness of ½ inch (12.7 mm), an approximate width of 2½ inches (73.5 mm), and an approximate length of 32 inches (812.5 mm). A first end 23 of bar 5 is adaptable for rotatively engaging sides 25 and 25A of second roof sections 7B. Pivotal fasterers 15A, which are equivalent to fastener 15, also attach to roof section 7B and through apertures 17A at end 23 of lifting bars 1 in order to connect the pair of lifting bars 1 to sides 25 and 25A. Opposite end 27 of bar 5 is pivotally connected to bar 3 generally intermediate ends 11 and 19. Lifting bars 1 may be in either a straight configuration 31, as depicted in FIGS. 1, 2 and FIG. 3, steps 2 through 4, or in a folded configuration 29, as depicted in FIG. 3 steps 1 and 5.

A flexible member 33 (which also may be of any material of sufficient strength to withstand fracture during elevation of roof sections 7 such as a chain, rope or cable) has an upper end 33A connected to hoist 35. A lower end 33B of flexible member 33 is connected at the pivotal connection 37 between bars 3 and 5, and extends to wrap about sheave 9.

Conventional fasteners 39, of a kind typically employed in the construction arts, join bars 3 and 5 to one another at connection 37.

Figure 3:
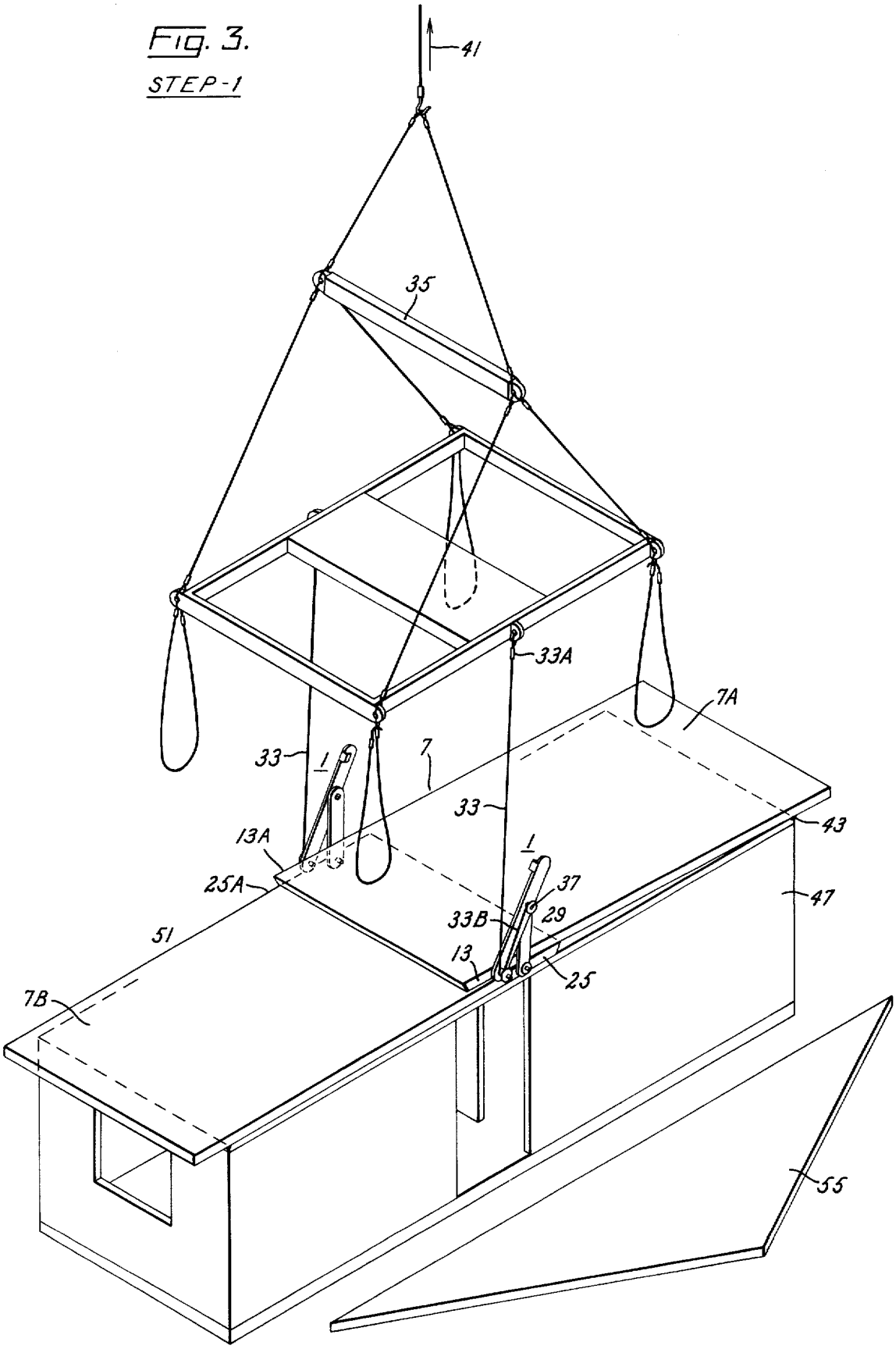
FIG. 3 illustrates a sequence of steps in a process for elevating folded roof panel sections utilizing the lifting bars of FIG. 1 and hinge plates.
Figure 3:
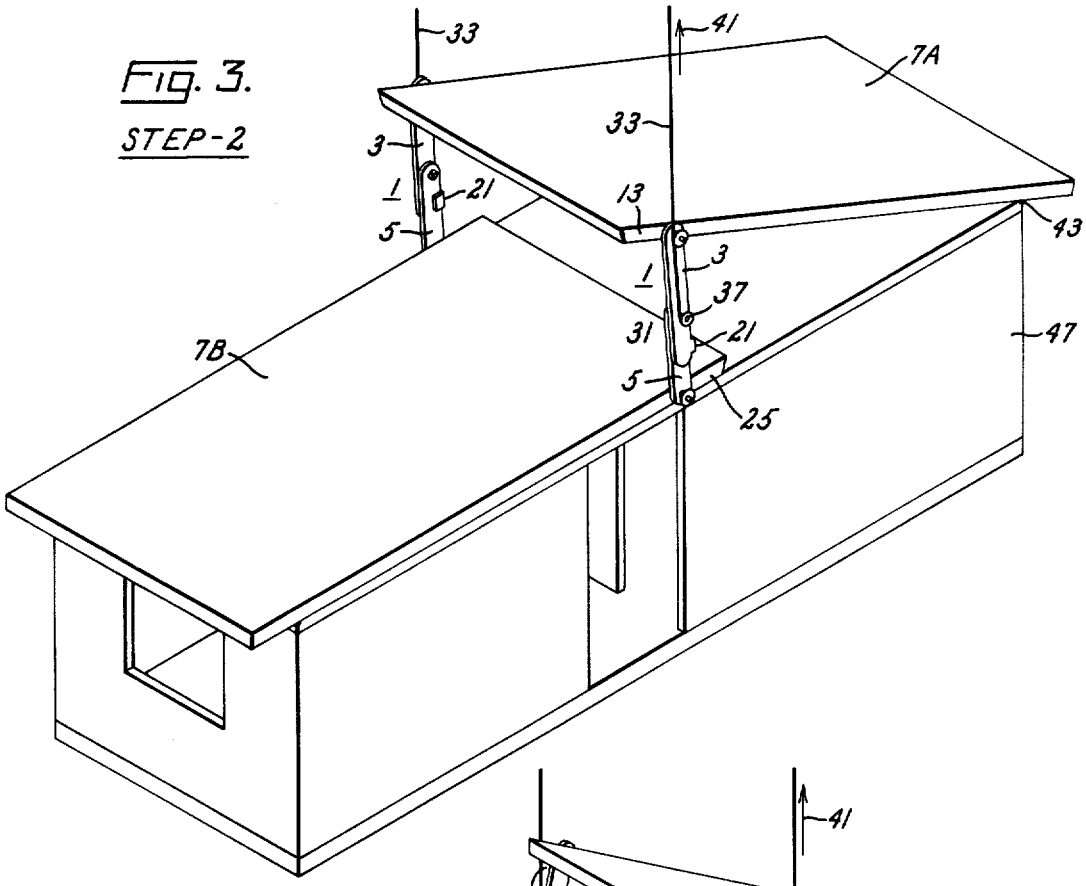
Figure 3:
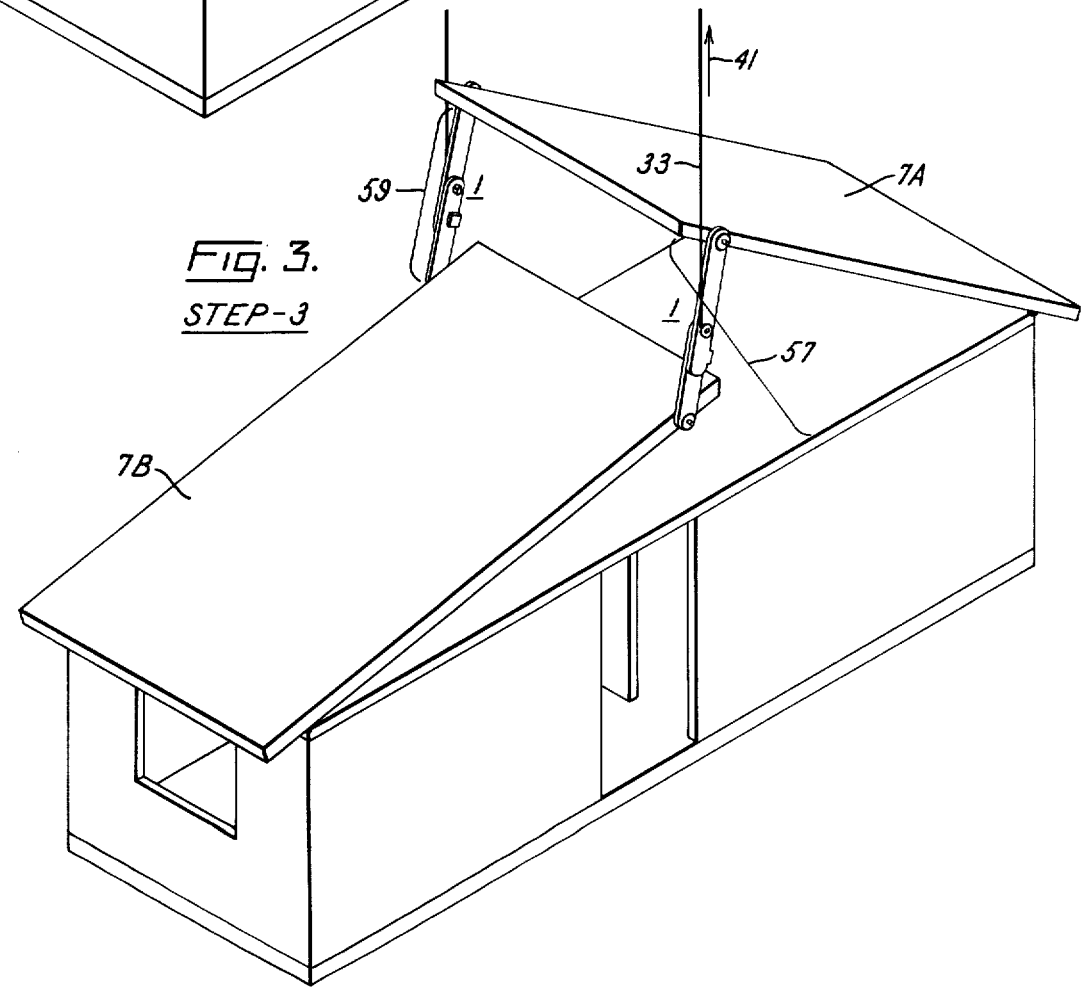
Figure 3:
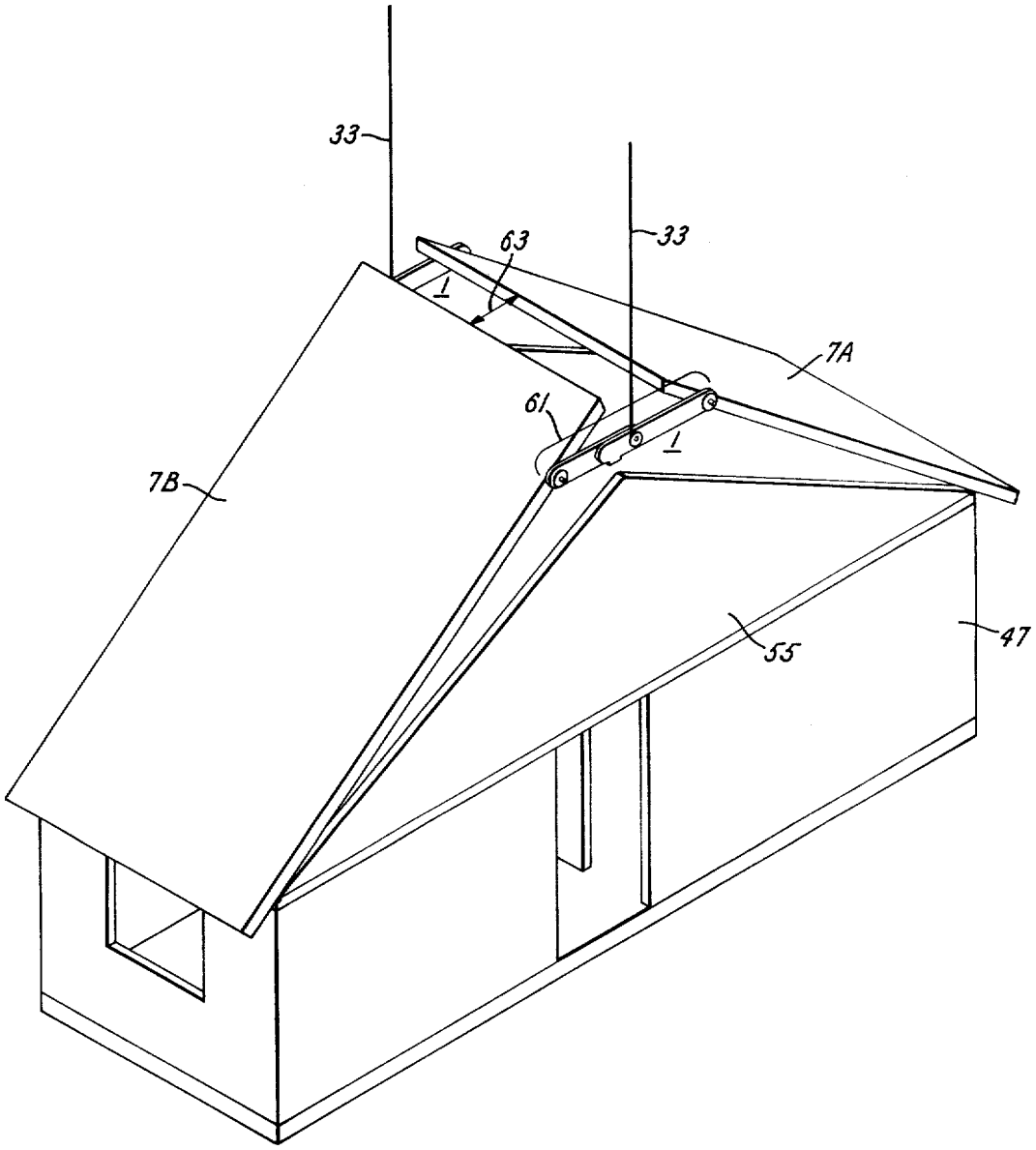
Figure 3:
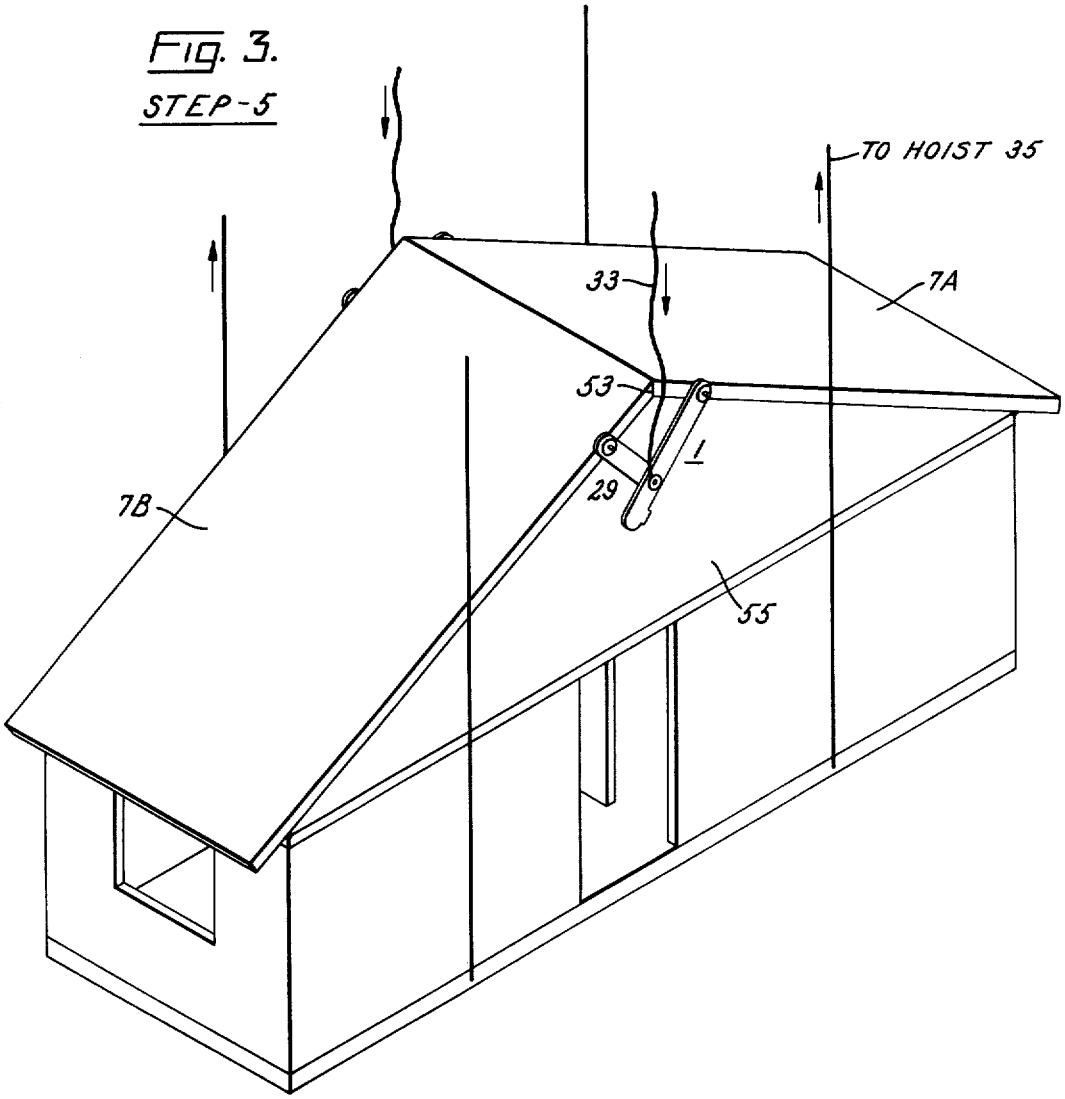

Normally, before an initial upward pulling force 41, illustrated at FIG. 3, step 1, is applied to lifting bars 1, lifting bars 1 are in start or folded configuration 29. However, when force 41 is transmitted to lifting bars 1 by hoist 35 through flexible member 33, pivotal connection 37 enables sheave ends 11 to rotate upward while locking ends 19 rotate downward to engage and clasp bars 5, intermediate ends 23 and 27. When lock 21 clasps bar 5, further rotation of ends 11 and 19 are prevented and bars 3 and 5 join one another in the extended, straight, locked bar configuration or form 31 as best seen at steps 2 through 4 of FIG. 3. In straight configuration 31, bars 3 and 5 function as one whole integrated bar, rather than as two individual bars.

Figure 4:
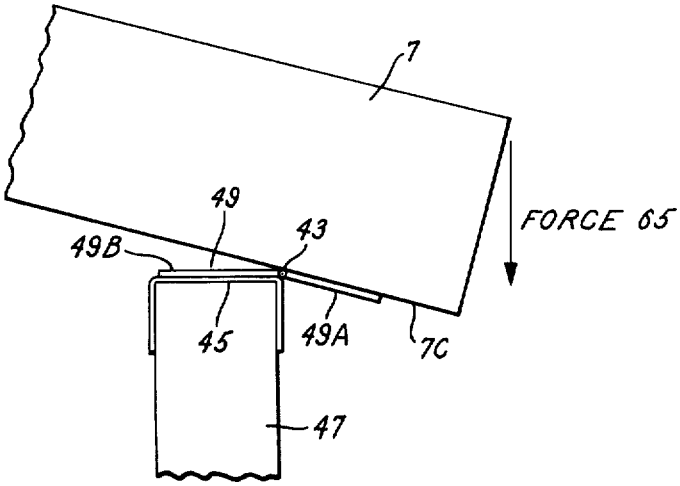
FIG. 4 is a detailed view from FIG. 3 illustrating a hinge plate for supporting and elevating panel roof sections.

At corner junctions 43 between the top ends 45 of side walls 47 and roof sections 7, illustrated at FIGS. 3 and 4, a plurality of hinge plates, generally designated as 49, substantially support roof sections 7 while roof sections 7 are in a transport or folded position 51. Hinge plates 49 are flat rectangular plates and are made out of metal. But, plates 49 are not limited to manufacture from metal only and may be constructed from any material strong enough to substantially support roof sections 7.

Plates 49 comprise principally two segments and are normally utilized without conventional fasteners such as rivots, screws or bolts although conventional fasteners may be used. A first segment 49A extends out from top ends 45 of walls 47 and substantially support roof sections 7 in folded position 51. A second segment 49B of plates 49 are welded to top ends 45 of walls 47. Ends 49A are fastened to roof sections 7 at ends 7C of section 7. However, when roof sections 7 are adjusted to a final pitch and position 53 as required by design specifications, end gables 55 installed subsequent to acquiring position 53, carry the structural load of roof sections 7, and substantially support roof sections 7 during the lifetime of the constructed modular unit.

During the typical process of elevating roof sections 7 to final position and pitch 53, lifting bars 1 are initially in folded or start configuration 29. When force 41 is applied to lifting bars 1, via hoist 35 and flexible member 33, each lifting bar 1 unfolds and jackknifes, or rotates out of folded configuration 29, into straight configuration 31. While lifting bars 1 unfold into straight configuration 31, first sections 7A are elevated from the transport or folded position 51 to an intermediate pitch and position, designated as 57 for clarity and illustration. See FIG. 3, step 3. Hence, position 57 is obtained by elevating roof section 7A until lifting bars 1 are straight and have rotated so lifting bars 1 assume a generally vertical straight position 59 with respect to section 7A.

An additional force 41 applied to lifting bars 1, enable lifting bars 1 to rotate out of vertical straight position 59 to horizontal straight position 61, remaining second roof sections 7B and first roof sections 7A are together respectively elevated from folded transport position 51 and intermediate position 57 to an overrun pitch and position (designated as 63 for clarity and illustration) that is greater than the pitch and position needed to install end gables 55.

Additionally, force 41 acting on lifting bars 1, causes ends 7C of roof sections 7 to exert a pivotal force 65, as shown in FIG. 4, on segments 49A of hinge 49. Force 65 causes segments 49A to bend downwards at an angle to segments 49B of a size approximately equal to an angle determined by final pitch and position 53.

Subsequent to elevating roof sections 7 to position 63, end gables 55 are installed and roof sections 7 are adjusted into final position 53 by lowering roof sections 7 from position 63 into final position 53. With roof sections 7 in final position 53 and attached to end gables 55, segments 49A of hinges 49 no longer substantially support roof sections 7, as end gables 55 substantially carry the structural load of roof sections 7 during the lifetime of the modular construction unit.

When force 41 is removed, which normally occurs after end gables 55 are installed and final position 53 is obtained, bars 3 and 5 of lifting bars 1 refold from straight configuration 31 into folded configuration 30. Lifting bars 1 may then be removed and reused on the next modular construction while hoist 35 is utilized to move or locate modular units as is apparent from step 5 of FIG. 3.

It is apparent that it is possible to produce still other embodiments of the lifting bars 1 or the process for elevating roofs with lifting bars 1 without departing from the scope of the inventive concept herein disclosed. Accordingly, all the matter contained in the above description and in the accompanying drawings should be interpreted as illustrative and not in a limiting sense.

What I claim as new and desire a Letters Patent of the United States is:

1. A lifting apparatus for elevating first and second roof sections which comprises:

(a) a first pair of lifting means, wherein each of said first pair includes at one end thereof circular means adaptable for rotatively engaging different sides of said first roof section and for transmitting a pulling force, and each of said first pair further including locking means at another end thereof;

(b) a second pair of lifting means, wherein each of said second pair includes at a first end thereof means adaptable for rotatively engaging different sides of said second roof section, and each of said second pair further including means pivotally connecting a second end thereof to a respective one of said first pair at a point intermediate said one and other ends thereof (c) a hoist means; and (d) flexible means extending from said second end of each of said second pair around said circular means at said one end of a respective one of said first pair to said hoist means, whereby upon application of the pulling force to said flexible means, each of said circular means begins to rotate upwards about a respective one of said second end of said second pair as said first and second pair rotate out of a folded configuration until each said locking means rotates downward to clasp and engage a respective one of said second pair to form a straight configuration, thereby moving said first roof section upward, and upon further application of the pulling force to said flexible means, said first and second pair remain in the straight configuration as said first end of each of said second pair rotate upward about said one end of a respective one of said first pair, thereby lifting said second roof section while continuing the lifting of said first roof section until both of said roof sections are elevated to a desired pitch.

2. A lifting apparatus as recited in claim 1, wherein said first and second pair of lifting means are elongated metal bars.

3. A lifting apparatus as recited in claim 2, wherein each said circular means comprise sheaves connected to said bars for said tramsmitting of said force.

4. A lifting apparatus as recited in claim 3, wherein said locking means comprises a latch for joining and locking said first pair of said bars to said second pair of bars in said straight configuration, and wherein said first and second pair of bars function as one whole integrated bar while in said straight configuration.

5. A lifting apparatus as recited in claim 4, wherein said flexible member is a cable.

* * * * *